United States Patent [19]

Rosseau

[11] 3,952,359

[45] Apr. 27, 1976

[54] BRUSH STRIP FOR ROTARY COILED BROOM

[75] Inventor: Richard B. Rosseau, Claremont, Calif.

[73] Assignee: FMC Corporation, San Jose, Calif.

[22] Filed: Jan. 20, 1975

[21] Appl. No.: 542,316

[52] U.S. Cl. ..... 15/182
[51] Int. Cl.[2] ..... A46B 7/10
[58] Field of Search ..... 15/179–183, 15/198, 200; 300/21

[56] References Cited

UNITED STATES PATENTS

| | | | |
|---|---|---|---|
| 2,281,412 | 4/1942 | Cave et al. | 15/182 |
| 3,109,190 | 11/1963 | Nelson | 15/181 |
| 3,193,866 | 7/1965 | Jones | 15/182 |
| 3,750,225 | 8/1973 | Gould et al. | 15/182 |

*Primary Examiner*—Peter Feldman
*Attorney, Agent, or Firm*—R. S. Kelly; C. E. Tripp

[57] ABSTRACT

An improved coiled brush strip for a rotary broom of the type which might be used in a street sweeper. The broom generally comprises a cylindrical core and a coiled brush strip with the ends of the brush strip being secured to the opposite longitudinal ends of the core to securely tighten the brush strip upon the cylindrical face of the core. The brush strip includes a metallic channel element which receives a plurality of closely bunched, radially extending bristles throughout its length. The underside of said channel element, which engages the cylindrical face of the core, is provided with spaced protrusions which act to slightly space portions of the channel element from the core face. Thus, when the brush strip is tightened upon the core, the channel element can be distorted into engagement with the core and thereby spring-loaded about said protrusions so that it will remain in tight gripping engagement with the core even if there is slight loosening movement at one end of the coiled brush strip as, for example, upon removal of a sweeping load.

8 Claims, 5 Drawing Figures

BRUSH STRIP FOR ROTARY COILED BROOM

BACKGROUND OF THE INVENTION

1. Field of the Invention

The present invention pertains to rotary power brushes of the street sweeping broom type, and more particularly, it pertains to an improved helically coiled brush strip which can be maintained in a tight non-slip condition upon the cylindrical surface of a broom core member under both brushing load and unloaded conditions.

2. Description of the Prior Art

A typical construction for a rotary power brush, such as might be used on street sweepers for example, comprises a generally cylindrical core member about which a helical brush strip is tightly wrapped. The brush strip includes a channel element having a tightly bunched, continuous series of reversely bent bristles secured therein. The bristles are arranged to be secured within the channel at their bight portions by means of an anchoring wire or cable which extends the full length of the brush strip.

In one rotary brush construction of the aforedescribed type that is widely used in the street sweeper industry and is shown in prior U.S. Pat. No. 3,193,866 to Jones, one end of the brush strip is fastened to the core by means of a slack accumulator device which comprises a flexible cable attached to the end of the brush strip and to the end face of the core so as to allow the brush strip to rotate in one direction if slack develops along the length thereof but preventing it from rotating in the opposite direction wherein it would unwind from the core. When slack does develop in the brush strip, the attachment of the aforementioned cable to the end face of the core can be loosened, and the brush strip can be pulled tighter about the core to remove such slack before reclamping the cable to the core. Thus, by means of periodic manual take-up of the slack in the brush strip, the brush strip can be maintained in a tightened condition on the core.

In the aforementioned prior art rotary coiled brush construction as shown in U.S. Pat. No. 3,193,866, it was found to be necessary to provide a fixed helical guide track upon the surface of the core for receiving the coiled brush strip in order to maintain the coils of the brush strip in the proper spaced relationship and thereby achieve a good brushing action with the broom. If the track were not provided, any slackness which developed in the brush strip might result in a spreading of certain adjacent coils which would leave an undesirable streak in the brushed strip of road surface or pavement.

Attempts to improve this basic rotary coil brush construction and overcome the foregoing problem are disclosed in the recently issued U.S. Pat. No. 3,750,225 to Gould et al, and in my pending patent application Ser. No. 491,021, assigned to the assignee of the present application. The rotary brushes described and shown in these patent disclosures also include a helical brush strip which is arranged to be tightly secured about a cylindrical core. However, no guiding channel means are provided upon the cylindrical surface of the core for holding the brush strip coils in place. Instead, one or both ends of the brush strips are provided with one-way clutch or ratchet-type devices which provide for an automatic positive take-up of any slack in the brush strips as soon as it occurs. Thus, the need for the guide channel is allegedly obviated since the automatic take-up provided by the brush strip mounting means will maintain the brush strips in tight engagement with the cores at all times.

It has been found, however, that the automatic take-up devices do not always function as intended, and, particularly in those cases wherein the core is perfectly cylindrical, a certain amount of slack can develop during the removal of the sweeping load which can lead to an axial shifting of one or more coils upon the cylindrical face of the core. Thus, it has been found to be sometimes necessary to utilize auxiliary guide and spacing means for maintaining a fixed spacing of the coils of the brush strip (particularly at the end coils) so that they will not shift axially on the core during the use of the broom. Such means has heretofore included the use of a clip removably secured to the core which must be removed before the brush strip can be replaced on the core, and such removal has proven to be both a difficult and disagreeable job.

SUMMARY OF THE INVENTION

The improved brush strip of the present invention overcomes the problems involved with the prior art rotary coiled brushes, particularly the problem of the coils slipping upon the smooth cylindrical core element even after all efforts have been made to fully tighten the coiled brush strip upon the core or to provide for automatic slack take-up in the brush strip. The novel feature of the present invention comprises the provision of spaced protrusions on the inner face of the channel element of the brush strip which engages the cylindrical face of the core. These protrusions are spaced apart along the length of the brush strip by distances such that the large tensioning force applied to the strip will distort it and place portions of the strip in a spring-loaded condition. Thus, when a load is applied to the brush strip the coils thereof can deform about the protrusions upon which they rest. The coils then act as loaded springs. When the tensioning load is subsequently released slightly at one end of the brush strip the resultant spring release of the brush strip coils permits the strip to remain in tight engagement with the core at its contact points as defined by the spaced protrusions.

The present invention, which comprises a very simple modification to the coiled brush strip, has been found to be extremely effective and to entirely eliminate the necessity for tracks, special guide clip devices, or other means for maintaining the brush strip coils in specific fixed positions upon the underlying cylindrical core. The improved brush strip of the present invention has been found to be particularly useful when the supporting cores are perfectly smooth and cylindrical.

DESCRIPTION OF THE PREFERRED EMBODIMENT

Figure 1:
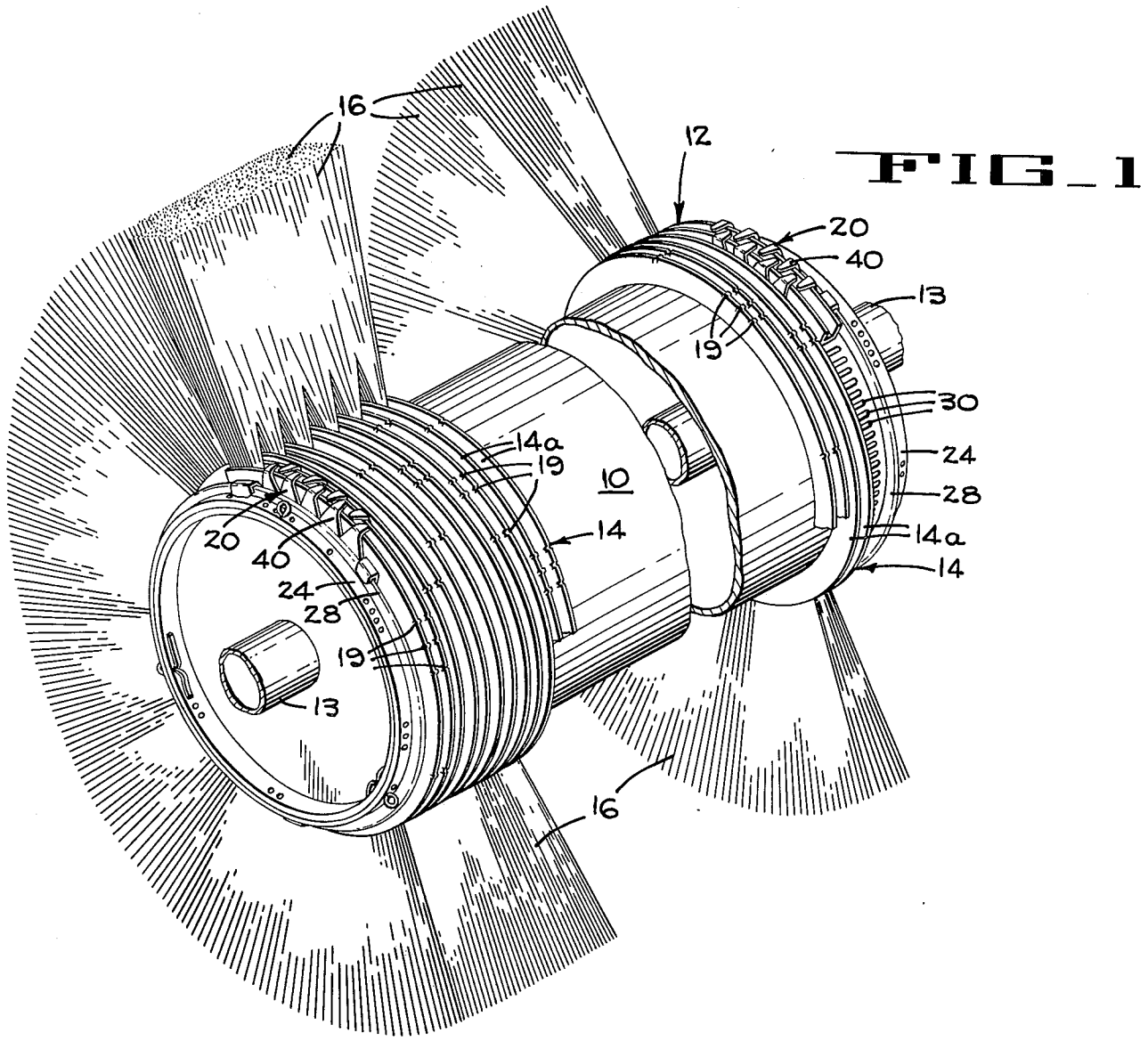
FIG. 1 is an isometric view of a rotary coiled broom of the type which might utilize the present invention, with portions thereof being broken away for the purpose of illustration.
Figure 3:
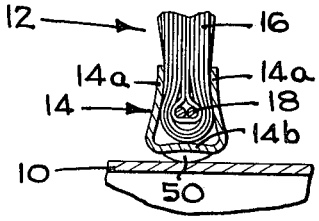
FIG. 3 is a transverse section through the brush strip of the present invention.

Referring more particularly to the drawings, FIG. 1 shows a rotary broom which will be seen to comprise a cylindrical core 10 about which is wrapped a helically coiled brush strip 12, the brush strip extending the full length of the core in rather closely spaced coils—all as is conventional. (It will be noted that, for the purposes of clarity, only a portion of the brush strip is shown at each end of the core, and, of the brush strip which is shown, only a portion thereof is shown complete so as to include the radially extending bristles.) An axle 13 is arranged to support the core upon a street sweeping machine (not shown) in the conventional manner. The brush strip 12, which is best shown in the cross-sectional view of FIG. 3, is generally conventional in construction and comprises a coiled metallic supporting channel element 14 within which is received a plurality of reversely bent and closely bunched bristles 16 that extend throughout the length of the brush strip. Each of the bristles is secured at the bight thereof within the supporting channel element 14 by means of an anchoring wire 18 which, in the described embodiment of the invention, comprises a twisted-pair anchoring wire as disclosed in prior U.S. Pat. No. 3,137,021. The bristles are additionally retained within the side walls 14*a* of the channel element by crimped portions 19 (FIG. 1) spaced along the outer side edges of the channel element.

An automatic slack accumulator take-up means 20 secures each end of the brush strip 12 to the longitudinal ends of the core 10 so that continuous positive accumulation of slack within the brush strip is obtained in order to tighten the coils of the strip down upon the cylindrical face of the core. These take-up devices are fully disclosed in my copending United States patent application Ser. No. 491,021, now U.S. Pat. No. 3,900915, filed on July 23, 1974, and will only be briefly described herein. Reference to such patent application may be had for a fuller and more complete description of the structure and method of operation of such slack accumulator take-up devices, although it will be recognized that an understanding of such structure and operation is not critical to an understanding of the present invention. Briefly, each of such slack accumulator take-up devices 20 comprise a cylindrical ring member 24 which is secured about the end surface of the core and which is provided with a radially outwardly extending track 28 and an adjacent series of apertures 30 closely spaced about the entire circumference of the ring member. Each end of the brush strip 12 is arranged to be securely attached to a clip, or guide member, 40 that is arranged to ride upon the track 28 of the associated ring member 24. The clip is provided with an inwardly extending tang (not shown) which is arranged to successively engage the apertures 30 in the ring whereby the clip (and hence the end of the brush strip) is permitted to move in only one rotary direction upon the surface of the ring member and is positively restrained from movement in the opposite rotary direction. Thus, once the brush strip 12 is tightened only a small amount of slack is permitted in the brush strip which permissible slack corresponds to the distance between adjacent apertures 30 in the ring member 24.

When the coiled brush strip 12 is attached about the core 10 of a rotary sweeper broom, the ends of the brush strip are first attached to the ring members 24. The brush strip coils (which are initially of a larger interior diameter than the exterior diameter of the core) and attached ring members are then merely slipped over the core and the ring members are attached at the ends of the core. The brush strip is subsequently tightened upon the core when the brush bristles 16 are subjected to loading (i.e., brushing) forces and the ends of the brush strip ride on the ring members to take all of the slack out of the brush strip and bring it into tight engagement with the core.

Despite the fact that the aforedescribed slack accumulator take-up devices 20 at the end of the brush strip succeed in maintaining the brush strip considerably tighter upon the core than did the previous manual tightening devices, such take-up devices still are ratchet-type mechanisms which permit a stretching of the brush strip at its ends under a load. When a slight retraction or loosening of the brush strip occurs as the brushing load is released and before the end of the brush strip locks into position, some axial slippage of the coils can occur. In the more conventional rotary coiled brooms wherein the brush strip is first manually tightened on the core as much as possible and wherein the ends of the brush strip are then securely fastened to the ends of the core, the possibility of a relaxation or loosening of the coils upon the removal of the brushing load is even more apparent. As explained previously, any loosening of the coils, even though slight, may result in an axial shifting of one or more coils which would ultimately result in subsequent improper sweeping action. This difficulty is particularly a problem at the ends of the brush strip where the sweeping action is critical.

Figure 2:
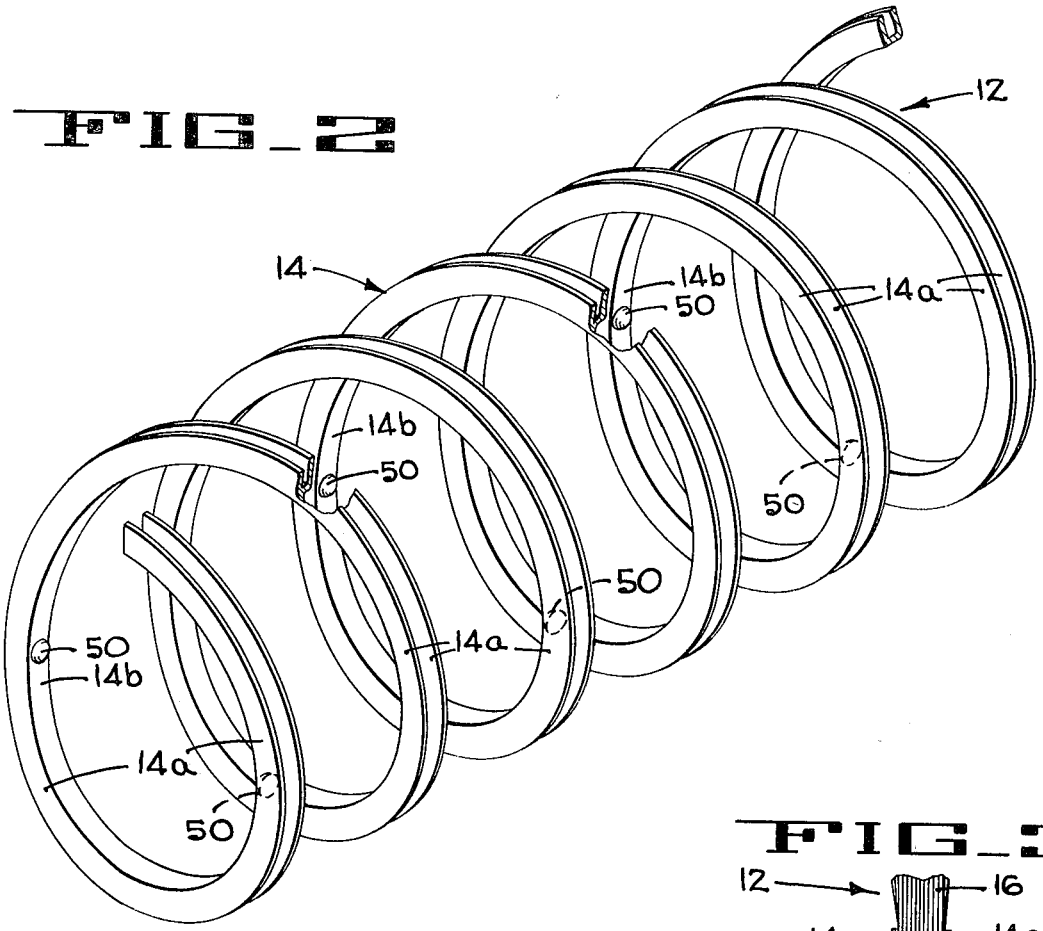
FIG. 2 is an isometric view of a portion of the supporting channel element of the rotary brush strip of the present invention.
Figure 4:
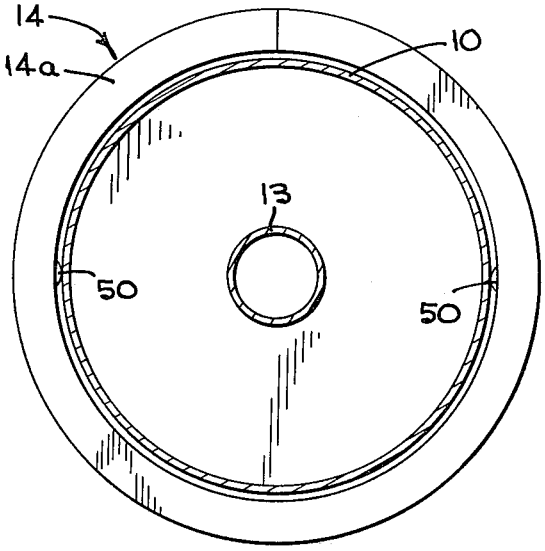
FIGS. 4 and 5 are operational views and comprise transverse sections through the rotary coiled broom of FIG. 1 with one coil of the brush strip channel element of FIG. 2 being shown in its untightened condition in FIG. 4 and in its fully tightened condition in FIG. 5.
Figure 5:
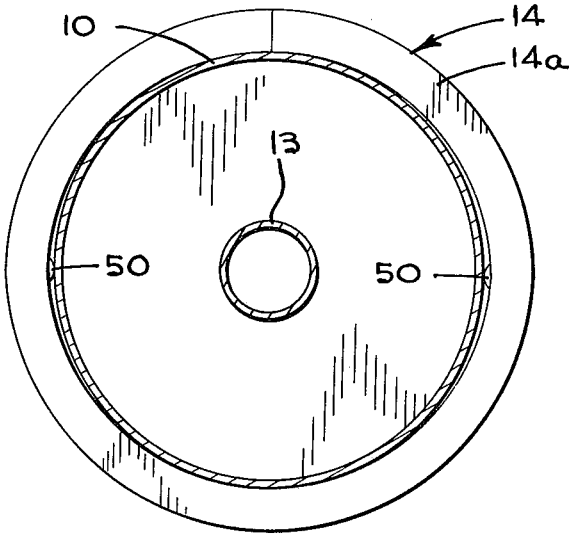

The improved brush strip 12 of the present invention which overcomes the aforedescribed problems includes a modified mounting channel element 14 which is best shown in FIG. 2 and which will be seen to be provided with a plurality of bumps or protrusions 50 upon the underside of the base 14*b* of the channel element 14 which is arranged to engage the cylindrical face of the core 10 after the brush strip is assembled upon the core. In FIG. 2 it will be seen that the protrusions 50 are spaced unevenly at ½ turn and 1½ turn spacings along the length of the channel element. However, it will be recognized that the particular spacing of the protrusions is not critical so long as the protrusions are spaced apart by distances along the length of the channel element so that the application of the tensioning forces on the brush strip during the tightening thereof cause the coiled channel element to distort and assume a non-cylindrical shape about the core. This distortion in one coil of the brush strip channel element is shown in FIGS. 4 and 5. In FIG. 4, a brush strip coil is shown in its normally tightened position where it is perfectly cylindrical and wherein it is supported upon the cylindrical face of the core by the protrusions 50. Then, under the severe tensioning forces due to increased loading, such as will occur during brushing for example, the coils are actually distorted so that major portions thereof move into engagement with the face of the core with only those portions adjacent the protrusions being slightly spaced from the core. The coils will then assume a slightly oblong shape as shown in FIG. 5. More importantly however, the coils are spring-loaded about the protrusions, and, upon a relaxation of the tensioning load on the brush strip, the slight take-up at one end of the strip can be accommodated by the springing of the coils outwardly into a more cylindrical orientation without allowing the coils to shift upon the face of the core since the strip will be fixed at the points where the protrusions engage the core. Thus, once reasonably tightened upon the core, the coils will remain fixed in position even though the core is perfectly cylindrical and with the coils being subjected to various increased tensioning forces which may temporarily stretch the brush strip channel somewhat.

The protrusions 50 are formed in the channel element 14 of the brush strip 12 of the present invention during the conventional roll-forming process wherein the channel element is rolled into a coil shape and the bristles 16 and anchoring wire 18 are placed therein. A punch or similar device is used to expand the metallic material (such as steel) of the channel element in a relatively small and generally circular area in the base 14b thereof. In the embodiment of the invention shown the protrusions are approximately 3/32ths of an inch in diameter and about 0.08 inches in height—although such dimensions are not to be taken as being in any way critical.

From the foregoing description it will be seen that the improved coiled brush strip of the present invention allows the strip to be placed upon cylindrical cores without having any fixed track elements or other guide means provided on the face of the core in order to maintain its coils in the proper position. The protrusions on the inner engaging portion of the brush strip coils provide a springiness to the coils which permit the accommodation of a minor amount of slack without requiring this to be taken-up at the ends of the strip. The protrusions may be very readily formed in the otherwise conventional supporting channel element of the brush strip without in any way unduly increasing the cost of the broom.

Although the best mode contemplated for carrying out the present invention has been herein shown and described, it will be apparent that modification and variation may be made without departing from what is regarded to be the subject matter of the invention.

What is claimed is:

1. In a rotary coiled broom which includes a cylindrical core, a helically coiled brush strip wound about the cylindrical face of said core, said brush strip being comprised of a channel element and a plurality of radially extending bristles secured within said channel element, and means for securing the ends of said brush strip to the longitudinal ends of said core, the improvement wherein said channel element is provided with a plurality of protrusions on the underside of the base thereof which is in engagement with the cylindrical face of the core, said protrusions being spaced apart by distances along the length of said channel element so that there are no more than two protrusions per turn; and said channel element having sufficiently flexibility so that the application of a tensioning force on said channel element, such as that occurring when said broom is loaded, causes it to distort and assume a non-cylindrical shape about said core with portions thereof being spring-loaded into engagement with said core face about said protrusions.

2. In a rotary coiled broom according to claim 1 wherein said channel element is formed of a relatively hard and resilient material such as metal.

3. In a rotary coiled broom according to claim 2 wherein said protrusions comprise expanded material structures integral with said channel element formed by expanding the channel element material with a punch in a small and generally circular area in said base of the channel element.

4. A helically coiled brush strip for use with a cylindrical core, and including means for securing the ends of said brush strip to said core to wind the strip tightly upon the cylindrical face of said core, said brush strip comprising a channel element extending the length of said brush strip and a plurality of radially extending bristles secured within said channel element throughout the length thereof, said channel element being provided with a plurality of protrusions on the underside of the base thereof which is arranged to engage said cylindrical face of the core, said protrusions being spaced apart by distances along the length of said channel element so that there are no more than two protrusions per turn, and said channel element having sufficient flexibility so that the application of a tensioning force on said channel element, such as that occurring when said broom is loaded, causes it to distort and assume a non-cylindrical shape about said core with portions thereof being spring-loaded into engagement with said core face about said protrusions.

5. A helically coiled brush strip according to claim 4 wherein said channel elemment is formed of a relatively hard and resilient material such as metal.

6. A helically coiled brush strip according to claim 5 wherein said protrusions comprise expanded material structures integral with said channel element formed by expanding the channel element material with a punch in a small and generally circular area in said base of the channel element.

7. In a rotary coiled broom according to claim 1 wherein said protrusions are spaced apart by at least ½ turn of said channel element.

8. A helically coiled brush strip according to claim 4 wherein said protrusions are spaced apart by at least ½ turn of said channel element.

* * * * *